US007331915B2

(12) United States Patent
Coullery et al.

(10) Patent No.: US 7,331,915 B2
(45) Date of Patent: Feb. 19, 2008

(54) ASSEMBLY DEVICE OF PLATE ELEMENTS FOR A PROCESSING MACHINE

(75) Inventors: Gérard Coullery, Villars-le-Terroir (CH); Sacha Bourgeois, Bussigny-près-Lausanne (CH)

(73) Assignee: Bobst SA (CH)

( * ) Notice: Subject to any disclaimer, the term of this patent is extended or adjusted under 35 U.S.C. 154(b) by 0 days.

(21) Appl. No.: 11/230,006

(22) Filed: Sep. 19, 2005

(65) Prior Publication Data

US 2006/0068981 A1 Mar. 30, 2006

(30) Foreign Application Priority Data

Sep. 27, 2004 (CH) ..... 01574/04

(51) Int. Cl.
*B31B 1/06* (2006.01)

(52) U.S. Cl. ..... 493/84; 493/121; 493/136; 493/210; 493/379

(58) Field of Classification Search ..... 493/75, 493/76, 78, 79, 210, 379, 382, 386, 389, 493/391, 84, 114, 120, 136, 122–128, 141–142
See application file for complete search history.

(56) References Cited

U.S. PATENT DOCUMENTS

| | | | | |
|---|---|---|---|---|
| 2,016,462 | A * | 10/1935 | Stokes | 493/59 |
| 2,111,157 | A * | 3/1938 | Stokes | 493/110 |
| 4,518,379 | A | 5/1985 | Eldridge | 493/334 |
| 4,650,448 | A | 3/1987 | Urso | 493/18 |
| 4,717,371 | A | 1/1988 | Everman et al. | 493/96 |
| 5,656,007 | A * | 8/1997 | Olson et al. | 493/84 |
| 5,681,252 | A * | 10/1997 | Ziegler | 493/84 |
| 7,074,171 | B2 * | 7/2006 | Mahlum et al. | 493/128 |
| 2002/0077236 | A1 | 6/2002 | Chalendar et al. | 493/19 |
| 2002/0084025 | A1 | 7/2002 | Fisch et al. | 156/264 |

FOREIGN PATENT DOCUMENTS

| | | |
|---|---|---|
| CH | 575 826 | 5/1976 |
| FR | 2 816 879 | 5/2002 |
| WO | WO 01/21389 A1 | 3/2001 |

OTHER PUBLICATIONS

European Search Report dated Feb. 15, 2006.

* cited by examiner

*Primary Examiner*—Hemant M. Desai
(74) *Attorney, Agent, or Firm*—Ostrolenk, Faber, Gerb & Soffen, LLP

(57) ABSTRACT

An assembly device for plate elements such as sheets of paper, cardboard, corrugated cardboard or similar material, for subsequent operation thereon in a processing machine. A feed station feeds elements to a positioning station for the plate elements. The positioning station for the plate elements includes a lower part equipped with first conveyors arranged side by side and an upper part including a second conveyor movable transversely with respect to the first conveyors. The second conveyor include grippers for the plate elements. The positioning station has a device for assembling the plate elements with respect to each other and an aligning device for longitudinally and transversely aligning the plate elements.

11 Claims, 3 Drawing Sheets

ASSEMBLY DEVICE OF PLATE ELEMENTS FOR A PROCESSING MACHINE

BACKGROUND OF THE INVENTION

The present invention refers to an assembly device for plate elements such as sheets of paper, cardboard, corrugated cardboard or similar material, for a processing machine.

Generally, the processing machine of plate elements which uses an assembly device is a folder-gluer which comprises a feed station followed by a breaking and prebreaking section for creasing lines of a folding box blank. The breaking and prebreaking section precedes a folding section, which includes a gluing device, followed by an ejection section for the box blanks which have been folded and glued, so as to bring these folded boxes, in a shingle stream, into a delivery station where the are pressed to ensure the glue setting. A folder-gluer is designed for processing box blanks of various sizes between a minimum size and a maximum size. For example, the width of a not yet folded corrugated cardboard box blank can reach up to three meters fifty to obtain a folded box having a width of one meter seventy. Assuming that the section of the mounted box is square-shaped, a parallelepiped box with sides of seventy centimeters would be obtained. For large-sized packaging requiring a quality printing, the size of the printing machines determines the maximum width of the blank. The printing of these blanks is normally carried out on machines allowing a maximum width of about two meters.

The market needs box blanks which are much larger-sized, for example three meters fifty, as mentioned above. In this case, cardboard articles in a plurality of pieces should be used, and these are generally assembled at the time of the packaging. Another solution is to connect two or more cardboard pieces by their lateral edges, so as to obtain a final blank of very large width. Cases can also arise wherein a box must be provided with a reinforcement or protection piece for the product to be packaged. Solutions for connecting two cardboard pieces have already been developed. One solution is described in patent FR 2 816 879 which refers to assembly equipment including a feed station comprising two magazines arranged on both sides of the median axle of the equipment. Each magazine is equipped with a blank picker for feeding two parallel conveyor belts provided with drive pins having to be implanted onto the conveyor belts at intervals corresponding to the dimension of the panels to be conveyed. Therefore, it is necessary to modify the position of the pins at each size change of the panels which are driven by the support of these pins onto their rear edges. This equipment also includes a gluing station of a linking strip of one of the panels as well as a connecting station, of the two panels, comprising two conveyor belts of the two panels and a transverse alignment means. This connecting station includes a rest surface having a ramp for raising the lateral edge of one of the panels and positioning it, in the alignment area, in a plane such that the lower surface of the panel is slightly raised with respect to the upper surface of the other panel which has a glued lateral strip. The transverse alignment is performed by a cylinder, or an equivalent means, which acts on the lateral edge of the panel to be connected to the other panel. Before connecting, a glue strip has been deposited on the linking strip of one of the panels. After connecting the two panels, pressure is exerted, on the two panels at the level of the linking strip.

This kind of equipment enables assembly of two cardboard panels and cannot be used for a different purpose such as inserting a reinforcement piece into a large-sized panel.

Inserting is frequently required for increasing the protective effect of the packaging on the product it contains. Such a device for inserting a reinforcement into a box blank is described in detail in Swiss patent CH 575 826.

SUMMARY OF THE INVENTION

The aim of the present invention is to at least partly obviate the drawbacks of the equipment known to practical workers of skill in the art and to provide a multi-functional device adaptable to a multitude of conditions.

To this end, the invention relates to an assembly device of plate elements, for a processing machine, according to the invention, which concerns an assembly device for plate elements such as sheets of paper, cardboard, corrugated cardboard or similar material, for enabling operation thereon in a processing machine. A feed station feeds elements to a positioning station for the plate elements. The positioning station for the plate elements includes a lower part equipped with first conveyors arranged side by side and an upper part including a second conveyor movable transversely with respect to the first conveyors. The second conveyor includes grippers for the plate elements. The positioning station has a device for assembling the plate elements one with respect to the other and an aligning device longitudinally and transversely aligning the plate elements.

Other features and advantages of the present invention will become apparent from the following description of the invention which refers to the accompanying drawings.

BRIEF DESCRIPTION OF THE DRAWINGS

The present invention will be more clearly understood from the description of an embodiment given by way of non-limitative example which refers to the accompanying drawings, wherein.

DESCRIPTION OF PREFERRED EMBODIMENTS

Figure 1:
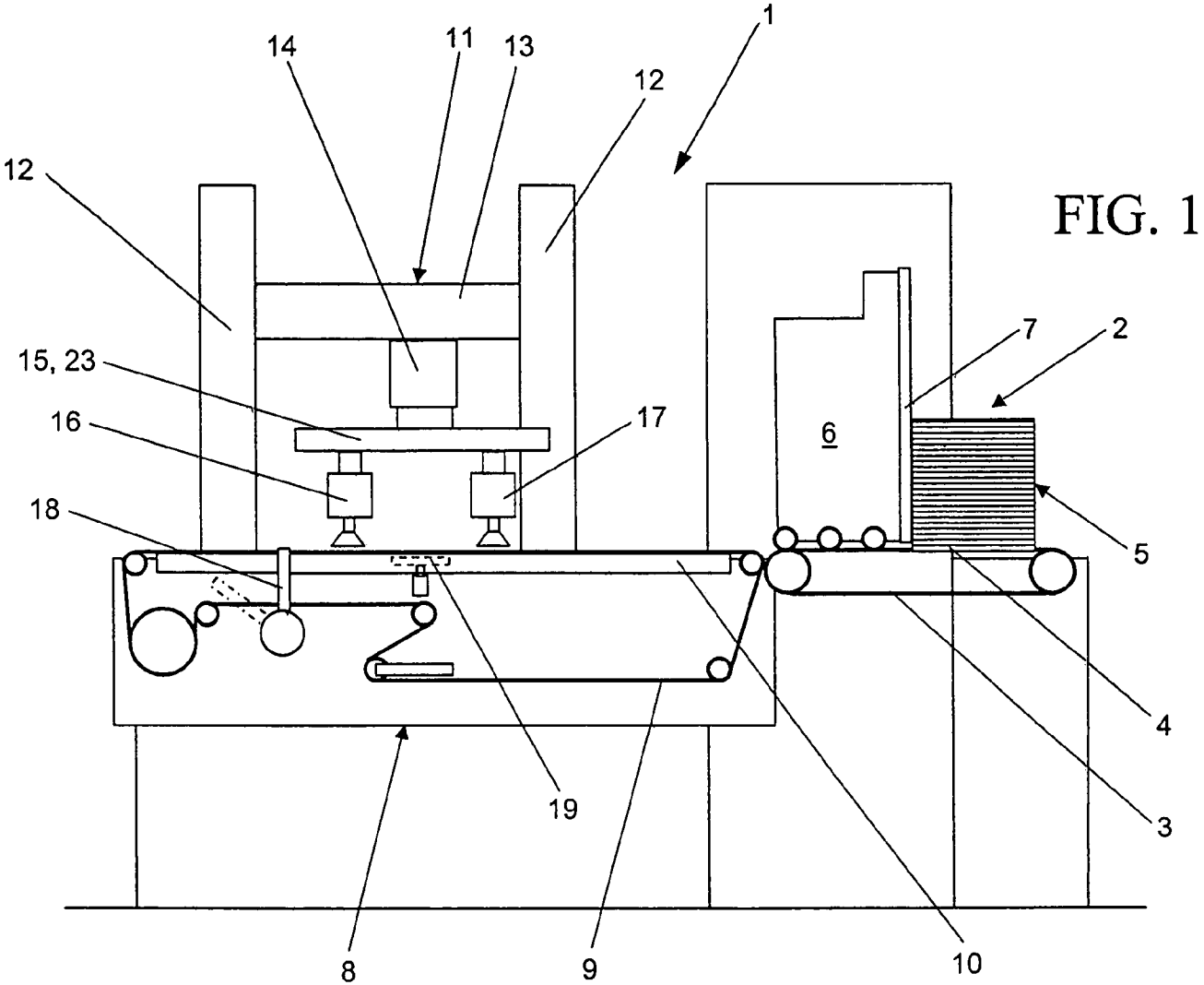
FIG. 1 is a schematic front view of an assembly device of the invention.

FIG. 1 is a schematic front view of an assembly device 1 comprising a feed station 2 including conveying means 3 for sheets 4 taken from one or a plurality of piles 5. These sheets 4 are introduced into the assembly device 1 by an introduction member 6 comprising one or a plurality of front gauges 7 for which lets only one sheet at a time pass under the lower part of the front gauges 7. The lateral arrangement of this feed station 2 will be described in greater detail in relation to FIG. 2. The sheets 4 are then brought one by one into a positioning station 8. This positioning station 8 comprises conveyors equipped with perforated conveyor belts 9 moving above a suction chamber 10. Preferably, a plurality of conveyors of this kind are arranged side by side over the width of the positioning station 8. The positioning station 8 is equipped, in its upper part, with a conveyor member 11 comprising a frame formed by vertical bars 12 linked by crossbars 13 supporting a slide 14, and on which one or two tables 15 and 23 move. Each table supports a series of telescopic suction heads 16 and 17. In this example, two tables 15 and 23 are provided. Preferably, movement of the tables 15 and 23 is obtained with a linear motor, and the movement of the table 15 is controllable independently of the movement of the table 23. The lower part of the positioning station 8 is provided with a series of front stops 18, which can be retracted, and with a series of lateral stops 19 some of which can be moved laterally and vertically.

Figure 2:
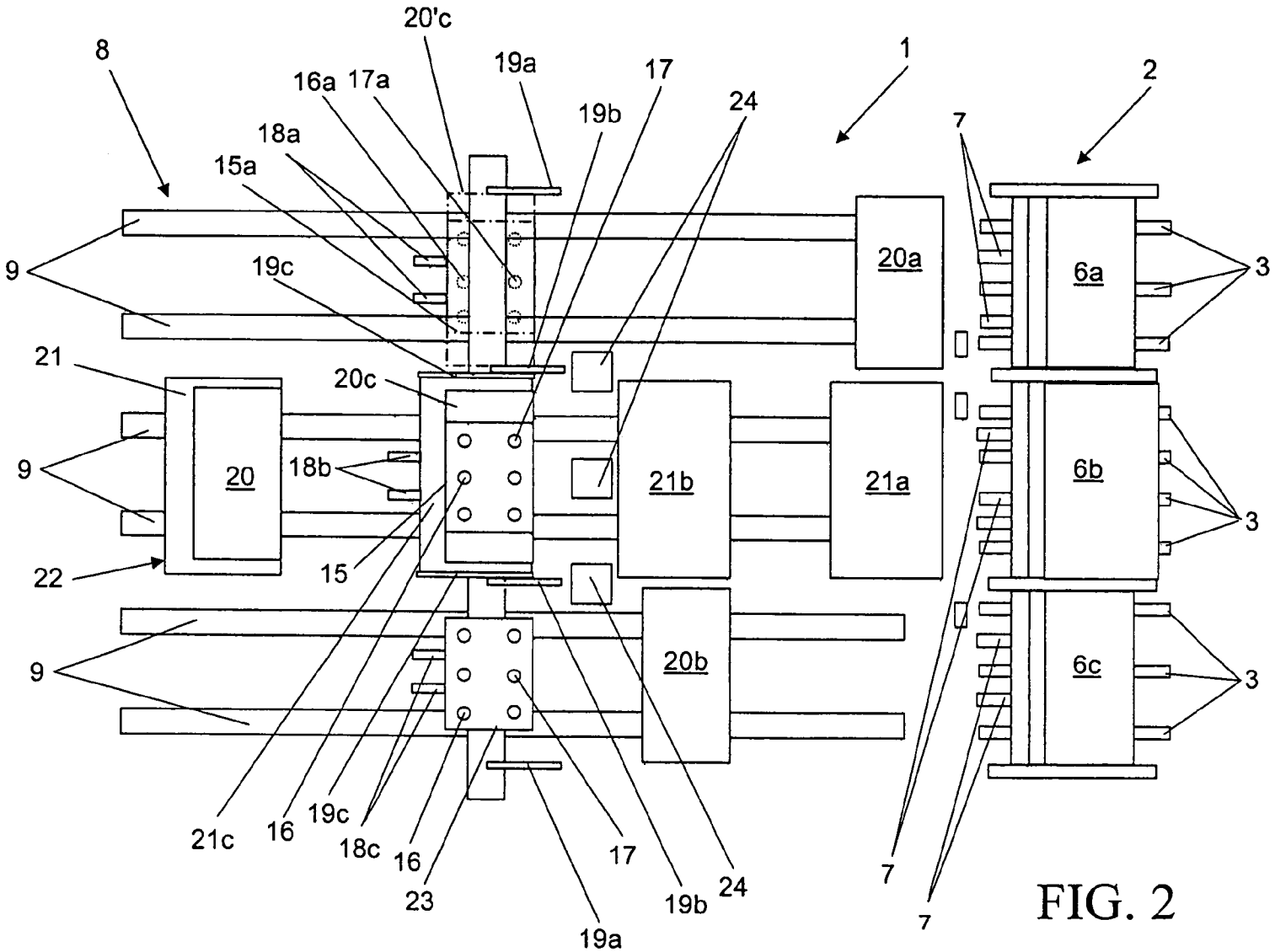
FIG. 2 is a schematic plan view of FIG. 1.

FIG. 2 is a schematic plan view of FIG. 1 wherein an inserting operation of a reinforcement 20 into a box blank 21 has been illustrated. In the embodiment illustrated in this Figure, the feed station 2 comprises three introduction members or adjustable feeders 6*a*, 6*b* and 6*c* arranged side by side across the width of the assembly device 1. These adjustable feeders 6*a* to 6*c* are adaptable to the size of the plate elements to be assembled or inserted. In the present example, the feeder 6*b* may be adjusted according to a box blank, whereas the feeders 6*a* and 6*c* each may be adjusted according to an insert. The feeder 6*b* is intended to successively deliver box blanks 21*a* to 21*c* on the central belt conveyors 9 whereas the feeders 6*a* and 6*c* are intended to deliver inserts or reinforcements 20*a* to 20*c* on the laterally positioned conveyor belts 9. The plate elements, i.e. the box blanks and the inserts, are alternately delivered two by two by the feeders 6*b* and 6*a* and by the feeders 6*b* and 6*c*, as illustrated by the plate elements 20*a* and 21*a* as well as by the plate elements 20*b* and 21*b*. In the positioning station 8, an insert 20*c*', shown in dot-and-dash lines, has been transported by the lateral conveyor belts 9 until coming into contact with the front stops 18*a* then in their high positions. In the same time, a box blank 21*c* has also been transported by the central conveyor belts 9 so as to come into contact with the front stops 18*b* then in their high positions. This box blank 21*c* is laterally aligned by the movable stops 19*c*. The insert 20*c*' is then aligned against a fixed lateral stop 19*a* by the movable stop 19*b*, then seized by the suction heads 16*a* and 17*a* of the table 15, shown here in the position 15*a*, which bring the insert 20*c*' above the box blank 21*c*, previously glued by means of the gluers 24 which, in the case of the assembly of an insert, can advantageously be glue guns. However, the use of any other gluing device is possible. It is also possible to use a gluing device for gluing perpendicularly to the cardboard passage direction by mounting glue guns on the tables 15, 23. The gluing can be applied either on the box blanks or on the inserts. In the case of the assembly of two blanks, the gluing can also be made over or under the gluing area. The gluing can be made obliquely as well by combining the movement of the tables 15, 23 with the forward motion of the cardboard. In the case of the assembly of two box blanks by their lateral edge, the gluers could possibly be replaced by fastening heads. Thus, the suction heads 16*a* and 17*a* are deactivated and the insert 20*c* is deposited on the box blank 21*c*. The front stops 18*b* are retracted and the whole 22 consisting of the insert 20*c* and the box blank 21*c* is removed from the device by the central conveyor belts 9 towards a machine for processing blanks, such as a folder-gluer. The movement of the table 15*a* in the direction of the box blank 21*c* causes the movement of the second table 23 into a position above the lateral conveyor belts 9 located at the left of the figure so that the insert 20*b* and the box blank 21*b* can be superposed in the same manner as the insert 20*c* and the box blank 21*c*. This superposition of the two plate elements occurs once on the right and once on the left of the assembly device, due to the simultaneous feed of an insert and a box blank.

Inserting of a reinforcement by the assembly device 1 is described above. Now the manner of joining together, by their lateral edges, two or a plurality of box blanks (see FIGS. 3*b*, 3*d* and 3*f*) with the same assembly device 1 is described. It is sufficient to act on the programming of the movements and strokes of the two tables 15 and 23. In fact, the program used by the assembly device 1 allows to adapt at will the movements and displacements of the various components of the device, either for acting upon the feeders 3*a* to 3*c*, the conveyor belts 9, the gluing or fastening devices 24, the tables 15 and 23, the suction heads 16 and 17 or the central or lateral stops 19*a*, 19*b* and 19*c*.

Figure 3A:
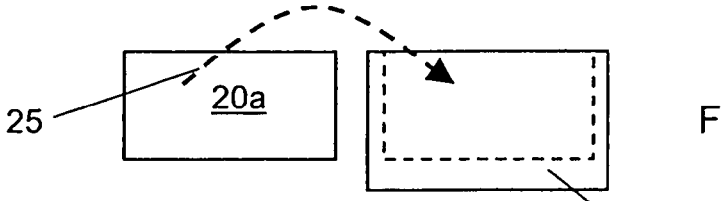
FIGS. 3*a* to 3*f* illustrate a plurality of assembly and inserting variants which can be carried out using of the assembly device of FIG. 1.
Figure 3B:
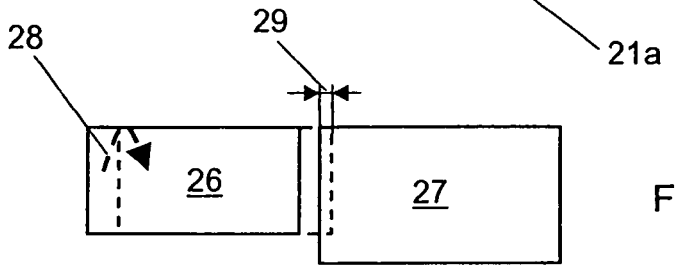
Figure 3C:
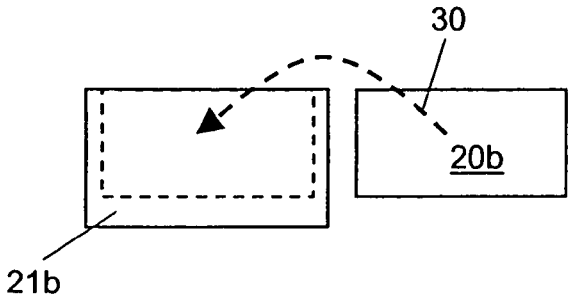
Figure 3D:
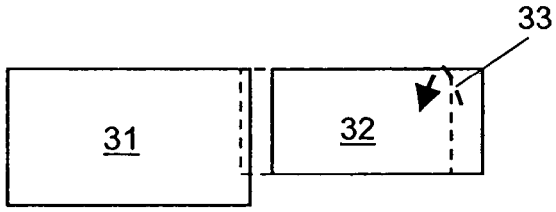
Figure 3E:
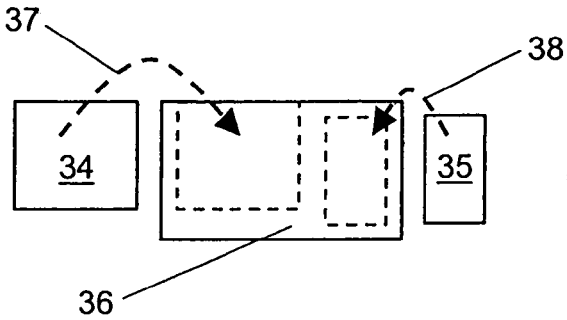
Figure 3F:
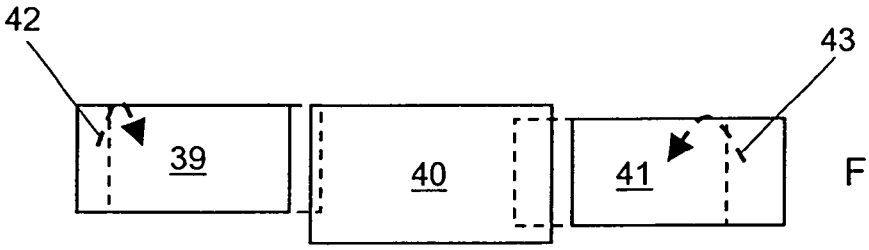

FIGS. 3*a* to 3*f* illustrate a plurality of assembly and inserting variants which can be carried out by the assembly device of FIG. 1. FIG. 3*a* illustrates insertion obtained by using plate elements delivered by the feeders 6*a* and 6*b*, i.e. the positioning of an insert 20*a* on a blank 21*a* in the direction shown by arrow 25. FIG. 3*b* illustrates the assembly of two box blanks 26 and 27 delivered by the feeders 6*a* and 6*b*, in the direction of arrow 28. It will be noted that for assembly of these two blanks, the translational motion of the tables 15 and 23 has been adapted in accordance with the covering 29 required by this operation. FIG. 3*c* illustrates insertion by the feeders 3*b* and 3*c*, i.e. in the direction of arrow 30, which is in opposition to the direction shown on FIG. 3*a*. FIG. 3*d* illustrates assembly of two box blanks 31 and 32 delivered by the feeders 6*b* and 6*c*, in the direction of arrow 33. FIG. 3*e* illustrates an additional inserting variant which can be carried out by the assembly device 1. In this Figure, an insert 34 is delivered by the feeder 6*a*, another insert 35 is delivered by the feeder 6*c*, this simultaneously with the delivery of a box blank 36 by the feeder 6*b*. The inserts 34 and 35 are simultaneously brought on the box blank 36 by the tables 15 and 23 respectively moving in the directions shown by arrows 37 and 38. FIG. 3*f* shows assembly of three plate elements 39, 40 and 41 for obtaining a very large-sized box blank, still by means of the same assembly device 1 having been programmed in appropriate manner. It is to be noted that during all the operations carried out on the various plate elements, the movement of the conveyor belts 9 has not been interrupted and these belts rub against the plate elements, creating a friction which could be controlled by adjustment of the suction force provided by the suction chamber 10. Moreover, during assembly of two or a plurality of blanks, the stops 19*b* and 19*c* are moved with an additional vertical movement so as to position the one or the other box blank in a plane allowing the covering of the concerned lateral edges by the assembly to be made.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An assembly device for plate elements for a processing machine, the device comprising:

a feed station operable for feeding the plate elements in a feed direction to an assembling device;

a positioning station operable for positioning the plate elements fed to the positioning station from the feed station;

the positioning station comprising a lower part equipped with first conveyors arranged side by side for conveying the plate elements in the feed direction and an upper part including a second conveyor which moves transversely with respect to the first conveyors, the second conveyor including a gripper operable to grip the plate elements; and the assembling device positioned and operable for assembling the plate elements into one package after the first conveyors have fed the plate elements to the assembling device, wherein the feed station comprises three feeders including a central feeder and two side feeders arranged side by side across the width of the assembly device and across the feed direction, the three feeders being adjustable to be selectively operable in either a first mode such that the three feeders feed the plate elements by simultaneously activating the central feeder and only a first side feeder of the two side feeders or in a second mode such that the three feeders feed the plate elements by simultaneously activating the central feeder and both side feeders.

2. The assembly device of plate elements according to claim 1, wherein the first conveyors of the lower part of the positioning station are comprised of perforated conveyor belts and a suction chamber above the perforated conveyor belts.

3. The assembly device of plate elements according to claim 1, wherein the second conveyor of the upper part of the positioning station comprises a first table equipped with the gripper; and a linear motor operable for moving the first table transversely to the feed direction.

4. The assembly device of plate elements according to claim 3, wherein the second conveyor further comprises a second table, and the second table being equipped with respective grippers for gripping a plate element of the plate elements, and wherein the linear motor is operable for moving the second table.

5. The assembly device of plate elements according to claim 4, wherein the linear motor further comprises two independent linear motors, each linear motor being operable for moving one of the tables.

6. The assembly device of plate elements according to claim 3, wherein the gripper of the plate elements comprises a plurality of telescopic suction heads.

7. The assembly device of claim 1, wherein the assembling device for assembling the plate elements comprises a glue gun.

8. The assembly device according to claim 1, wherein the assembling device for assembling the plate elements comprises fastening heads.

9. The assembly device of plate elements according to claim 1, wherein the alignment device comprises movable stops movable laterally and vertically, and opposite fixed stops, the alignment device being operable to stop the plate elements between the movable stops and the fixed stops.

10. The assembly device of claim 1, further comprising an alignment device for longitudinally and transversely aligning the plate elements before the assembling device assembles the plate elements.

11. An assembly device for plate elements for a processing machine, the device comprising:

a feed station operable for feeding the plate elements in a feed direction to an assembling device;

a positioning station operable for positioning the plate elements fed to the positioning station from the feed station;

the positioning station comprising a lower part equipped with first conveyors arranged side by side for conveying the plate elements in the feed direction and an upper part including a second conveyor which moves transversely with respect to the first conveyors, the second conveyor including a gripper operable to grip the plate elements;

the assembling device positioned and operable for assembling into one package the plate elements after the first conveyors have fed the plate elements to the assembling device, wherein the feed station comprises three feeders arranged side by side across the width of the assembly device and across the feed direction, the three feeders being selectively operable in either a first mode such that the three feeders feed the plate elements by simultaneously activating two of the three feeders or in a second mode such that the three feeders feed the plate elements by simultaneously activating all three feeders.

* * * * *